US006874867B2

(12) United States Patent
DeBar et al.

(10) Patent No.: US 6,874,867 B2
(45) Date of Patent: Apr. 5, 2005

(54) ELECTROSTATICALLY ACTUATED DROP EJECTOR

(75) Inventors: Michael J. DeBar, Rochester, NY (US); Edward P. Furlani, Lancaster, NY (US); Constantine N. Anagnostopoulos, Mendon, NY (US); Christopher N. Delametter, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 10 days.

(21) Appl. No.: 10/325,205

(22) Filed: Dec. 18, 2002

(65) Prior Publication Data

US 2004/0119782 A1 Jun. 24, 2004

(51) Int. Cl.[7] ..... B41J 2/06
(52) U.S. Cl. ..... 347/54
(58) Field of Search ..... 347/20, 54, 55; 29/890.1; 239/102.2

(56) References Cited

U.S. PATENT DOCUMENTS

| | | | |
|---|---|---|---|
| 4,908,679 | A | 3/1990 | Vora et al. |
| 5,300,444 | A | 4/1994 | Hachisuka et al. |
| 5,644,341 | A | 7/1997 | Fujii et al. |
| 5,668,579 | A | 9/1997 | Fujii et al. |
| 5,739,831 | A | 4/1998 | Nakamura et al. |
| 5,764,258 | A | 6/1998 | Hetzer et al. |
| 5,804,084 | A | 9/1998 | Nasby et al. |
| 5,890,745 | A | 4/1999 | Kovacs |
| 5,907,791 | A | 5/1999 | Cappuzzo et al. |
| 6,082,208 | A | 7/2000 | Rodgers et al. |
| 6,127,198 | A | 10/2000 | Coleman et al. |
| 6,174,820 | B1 | 1/2001 | Habermehl et al. |
| 6,235,212 | B1 | 5/2001 | Silverbrook |
| 6,318,841 | B1 | 11/2001 | Coleman et al. |
| 6,332,669 | B1 | 12/2001 | Kato et al. |
| 6,345,884 | B1 | 2/2002 | Yoon et al. |
| 6,357,865 | B1 | 3/2002 | Kubby et al. |
| 2001/0023523 | A1 | 9/2001 | Kubby et al. |

FOREIGN PATENT DOCUMENTS

| | | |
|---|---|---|
| WO | WO 90/09677 | 8/1990 |

OTHER PUBLICATIONS

Patent Abstracts of Japan entitled: Ink Jet Recording Head and its Production; Publication #—10086364; Publication Date—Jul. 4, 1998; Application #—08241644; Application Date—Dec. 9, 1996; Applicant: Ricoh Co Ltd; Inventor—Komai Hiromichi.

Patent Abstracts of Japan entitled: Ink Jet Head; Publication No.—11291485; Publication Date—Oct. 26, 1999; Application No.—10098811; Application Date—Oct. 4, 1998; Applicant: Minolta Co Ltd; Inventor: Asano Masami.

*Primary Examiner*—Thinh Nguyen
*Assistant Examiner*—Julian D. Huffman
(74) *Attorney, Agent, or Firm*—Milton S. Sales; Mark G. Bocchetti

(57) ABSTRACT

A drop emission device includes a chamber having a nozzle orifice through which a drop of liquid can be emitted. A deformable electrode is associated with the chamber such that movement of the electrode in a first direction increases the chamber's volume and movement of the electrode in a second direction decreases the chamber's volume to emit a drop through the nozzle orifice. A fixed electrode opposes to the deformable electrode to define a second chamber there between such that control of relative voltage differences between the deformable and the fixed electrodes selectively moves the deformable electrode in the first or second directions. The variable volume is vented to a source of dielectric material through an opening in the fixed electrode. The ratio of the cross-sectional area of the opening to the perimeter of the opening is greater than 0.5 $\mu$m, and is preferably about 5 $\mu$m.

18 Claims, 9 Drawing Sheets

ELECTROSTATICALLY ACTUATED DROP EJECTOR

CROSS-REFERENCE TO RELATED APPLICATION

Reference is made to commonly assigned, co-pending U.S. patent application Ser. No. 10/155,306 filed in the names of Gilbert A. Hawkins and James M. Chwalek on May 23, 2002.

FIELD OF THE INVENTION

The present invention relates generally to micro-electromechanical (MEM) drop-on-demand liquid emission devices such as, for example, ink jet printers, and more particularly such devices which employ an electrostatic actuator for driving liquid from the device.

BACKGROUND OF THE INVENTION

Drop-on-demand liquid emission devices with electrostatic actuators are known for ink printing systems. U.S. Pat. No. 5,644,341 and U.S. Pat. No. 5,668,579, which issued to Fuji et al. on Jul. 1, 1997 and Sep. 16, 1997, respectively, disclose such devices having electrostatic actuators composed of a single diaphragm and opposed electrode. The diaphragm is distorted by application of a voltage differential between two electrodes. Relaxation of the diaphragm expels an ink droplet from the device. Other devices that operate on the principle of electrostatic attraction are disclosed in U.S. Pat. No. 5,739,831, U.S. Pat. No. 6,127,198, and U.S. Pat. No. 6,318,841; and in U.S. Publication No. 2001/0023523.

U.S. Pat. No. 6,345,884 teaches a device having an electrostatically deformable membrane with an ink refill hole in the membrane. An electric field applied across the ink deflects the membrane and expels an ink drop.

IEEE Conference Proceeding "MEMS 1998," held Jan. 25–29, 2002 in Heidelberg, Germany, entitled "A Low Power, Small, Electrostatically-Driven Commercial Inkjet Head" by S. Darmisuki, et al., discloses a head made by anodically bonding three substrates, two of glass and one of silicon, to form an ink ejector. Drops from an ink cavity are expelled through an orifice in the top glass plate when a membrane formed in the silicon substrate is first pulled down to contact a conductor on the lower glass plate and subsequently released. There is no electric field in the ink. The device occupies a large area and is expensive to manufacture.

U.S. Pat. No. 6,357,865 by J. Kubby et al. teaches a surface micro-machined drop ejector made with deposited polysilicon layers. Drops from an ink cavity are expelled through an orifice in an upper polysilicon layer when a lower polysilicon layer is first pulled down to contact a conductor and is subsequently released.

One such device is disclosed in co-pending U.S. patent application Ser. No. 10/155,306 filed in the names of Gilbert A. Hawkins and James M. Chwalek on May 23, 2002. That device includes an electrostatic drop ejection mechanism that employs an electric field for driving liquid from a chamber in the device. Structurally coupled, separately addressable first and second dual electrodes are positioned on opposed sides of a third electrode. The first and second electrodes are movable in a first direction to draw liquid into the chamber and in a second direction to emit a liquid drop from the chamber.

In above-mentioned U.S. Pat. No. 6,127,198, air trapped between the distortable diaphragm and the opposed, fixed electrode is compressed when a voltage is applied to the electrode. The air chamber must have a relatively large volume to accommodate the compressed air; reducing the number of ejection nozzles that can be located in a given area.

U.S. Pat. No. 6,235,212 provides a vented space between a distortable diaphragm and the opposed, fixed electrode. The vent is a very thin slot around the perimeter of the device. Because the mechanism relies on hydrophobic layers between the electrodes to keep the chamber clear of fluid, the cross-sectional area of the perimeter vent gap is by necessity insufficient to provide adequate venting. The thickness of the vent is given in the patent as 0.5 $\mu$m. Even assuming that the entire perimeter on an 80 $\mu$m device were vented (although it is likely that, say, 25% of the perimeter would be used to anchor the device), the area of the vent would be only about 120 $\mu m^2$; as calculated below by approximating the area as the surface area of a cylinder:

$$2\pi r * \text{thickness} = 2\pi * 40\ \mu\text{m} * 0.5\ \mu\text{m}$$

$$\cong 120\ \mu\text{m}^2$$

The perimeter of the vent would be approximately 240 $\mu$m, for an area-to-perimeter ratio of 0.5 $\mu$m. This would be a very slowly venting device; and therefore would be slow to fire and refill.

SUMMARY OF THE INVENTION

It is an object of the present invention to provide a micro-electromechanical (MEM) drop-on-demand liquid emission device of the type discussed that is able to actuate and refill rapidly by providing a vent hole in the rear of the fixed electrode. As an example, a 20 $\mu$m diameter vent hole in the fixed electrode provides an area of 300 $\mu m^2$ with a perimeter of only 60 $\mu$m for an area-to-perimeter ratio of 5 $\mu$m. Thus, all other things being equal, the present invention would be able to actuate and refill approximately 10 times faster than would the device disclosed in U.S. Pat. No. 6,235,212.

According to a feature of the present invention, an emission device for ejecting a liquid drop includes a first chamber of variable volume adapted to receive a liquid. The chamber has a nozzle orifice through which a drop of received liquid can be emitted. An electrically addressable, deformable electrode is associated with the first chamber such that movement of the deformable electrode in a first direction increases the first chamber's volume to draw liquid into the first chamber and movement of the deformable electrode in a second direction decreases the first chamber's volume to emit a drop of liquid from the first chamber through the nozzle orifice. A fixed electrode, of predetermined perimeter, opposes to the deformable electrode to define a second chamber there between such that control of relative voltage differences between the movable and the fixed electrodes selectively moves the deformable electrode in one of the first and second directions. The variable volume contains a dielectric material and is vented to a source of such dielectric material through an opening of predetermined cross-sectional area in the fixed electrode. The ratio of the cross-sectional area of the opening to the perimeter of the fixed electrode is greater than 0.5 $\mu$m and is preferably about 5 $\mu$m.

DETAILED DESCRIPTION OF THE INVENTION

As described in detail herein below, the present invention provides a novel drop-on-demand liquid emission device. The most familiar of such devices are used as printheads in ink jet printing systems. Many other applications are emerging which make use of devices similar to ink jet printheads, but which emit liquids (other than inks) that need to be finely metered and deposited with high spatial precision.

Figure 1:
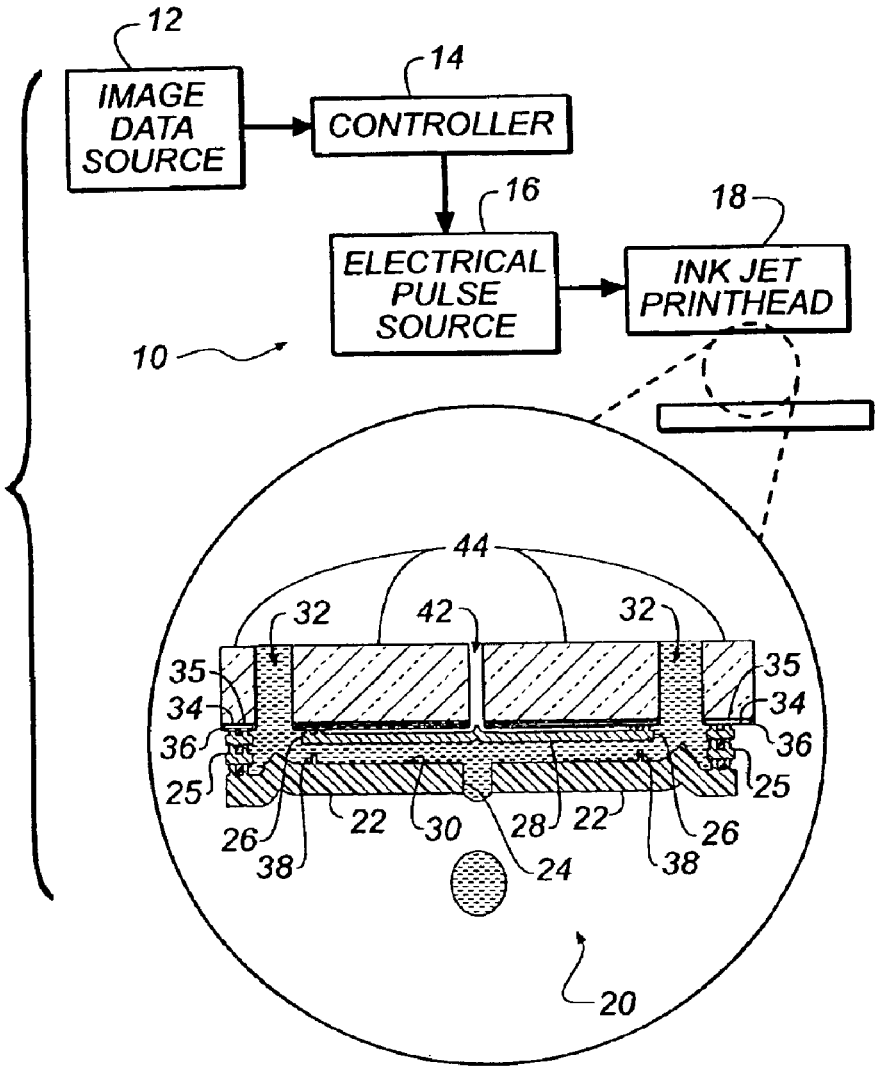
FIG. 1 is a schematic illustration of a drop-on-demand liquid emission device according to the present invention.

FIG. 1 shows a schematic representation of a drop-on-demand liquid emission device 10, such as an ink jet printer, which may be operated according to the present invention. The system includes a source 12 of data (say, image data) which provides signals that are interpreted by a controller 14 as being commands to emit drops. Controller 14 outputs signals to a source 16 of electrical energy pulses which are inputted to a drop-on-demand liquid emission device such as an ink jet printer 18.

Figure 2:
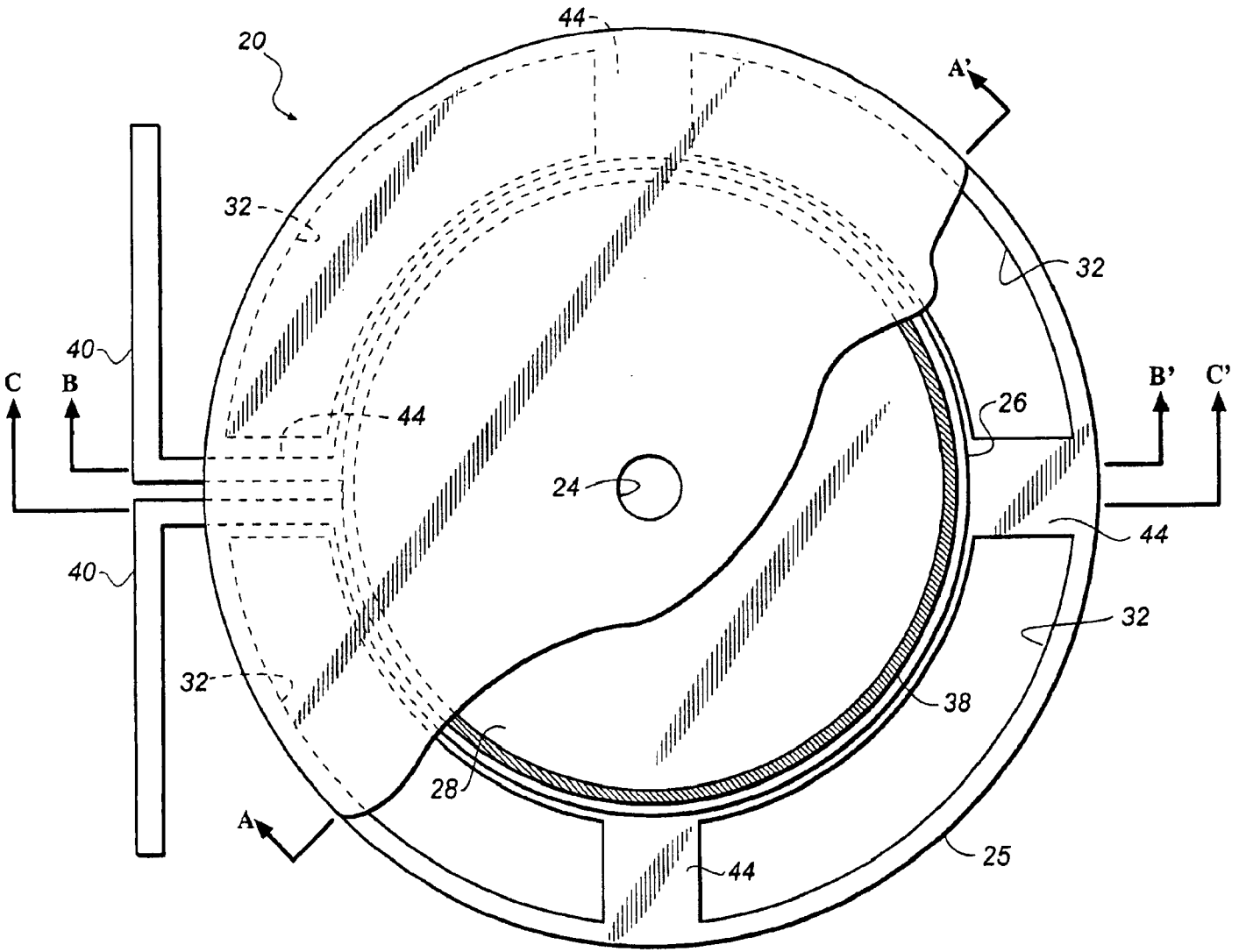
FIG. 2 is a top sectional view of a portion of the drop-on-demand liquid emission device of FIG. 1.

Drop-on-demand liquid emission device 10 includes a plurality of electrostatic drop ejection mechanisms 20. FIG. 2 is a top view of a portion of drop ejection mechanism 20 of FIG. 1 formed according to a preferred embodiment of the present invention. In this and the following figures, the structure continues to be illustrated in schematic form.

Figure 5:
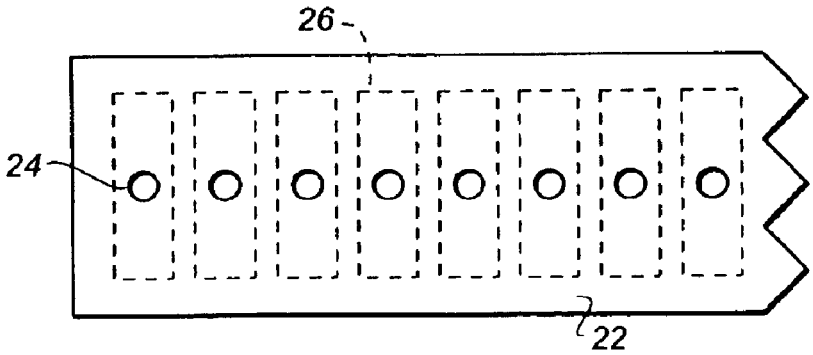
FIGS. 3–5 are top plan views of alternative embodiments of a nozzle plate of the drop-on-demand liquid emission device of FIGS. 1 and 2.
Figure 3:
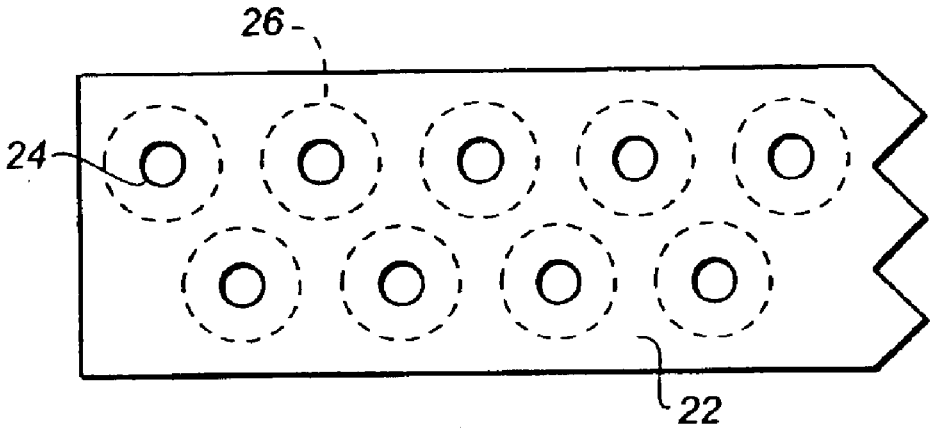
Figure 4:
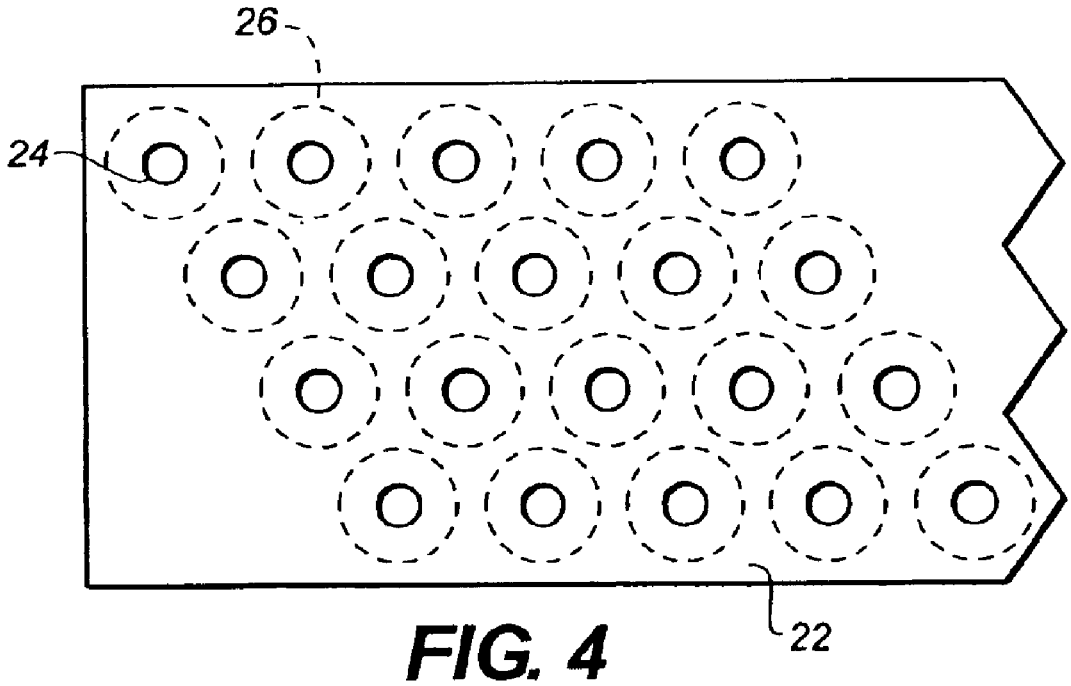

FIGS. 3–5 are top plan views of nozzle plate 22, showing several alternative embodiments of layout patterns for the several nozzle orifices 24 of a print head. Note that in FIGS. 2 and 3, the interior surface of walls 26 are annular, while in FIG. 5, walls 26 form rectangular chambers. Other shapes are of course possible, and these drawings are merely intended to convey the understanding that alternatives are possible within the spirit and scope of the present invention.

Figure 6:
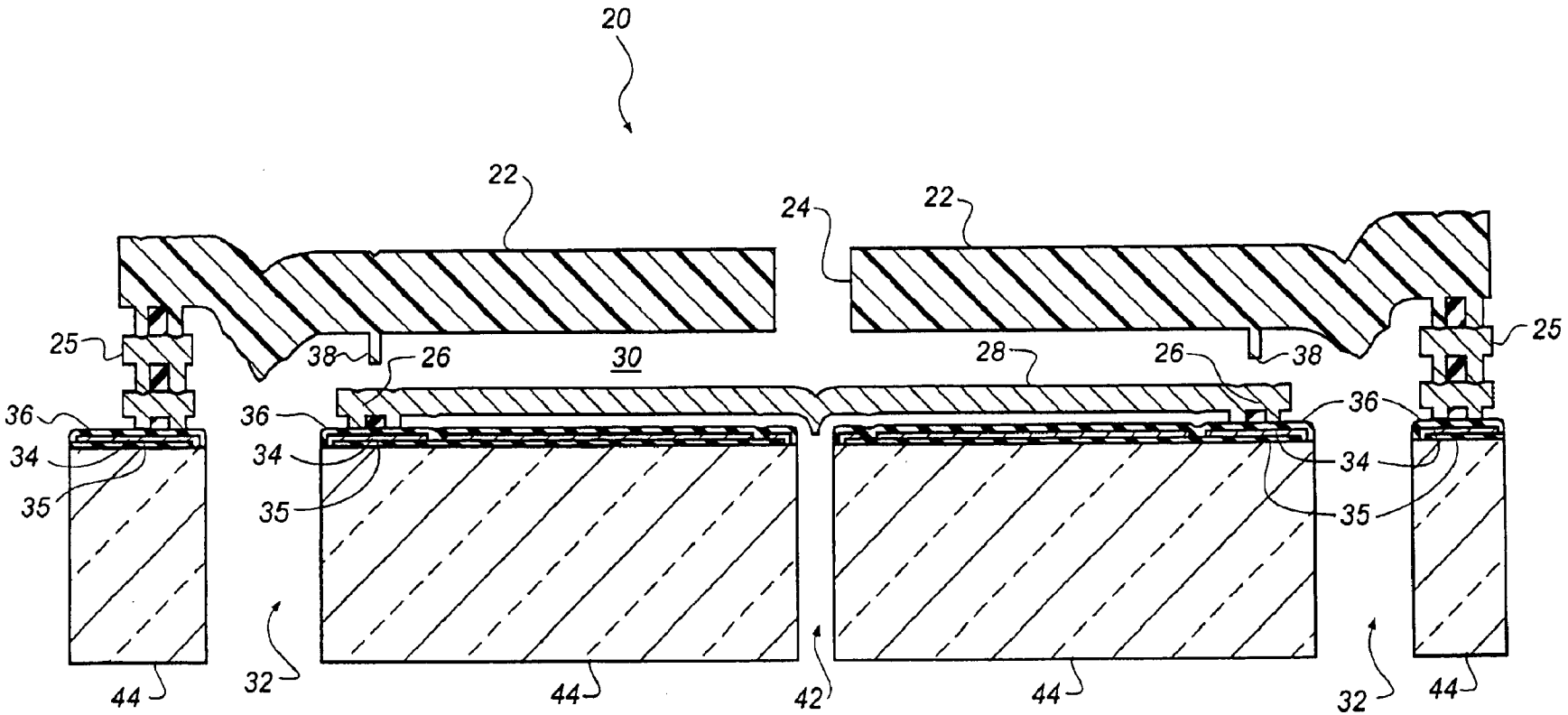
FIG. 6 is a cross-sectional view of the drop-on-demand liquid emission device of FIG. 1 taken along line A–A' of FIG. 2 with the mechanism at rest.
Figure 7:
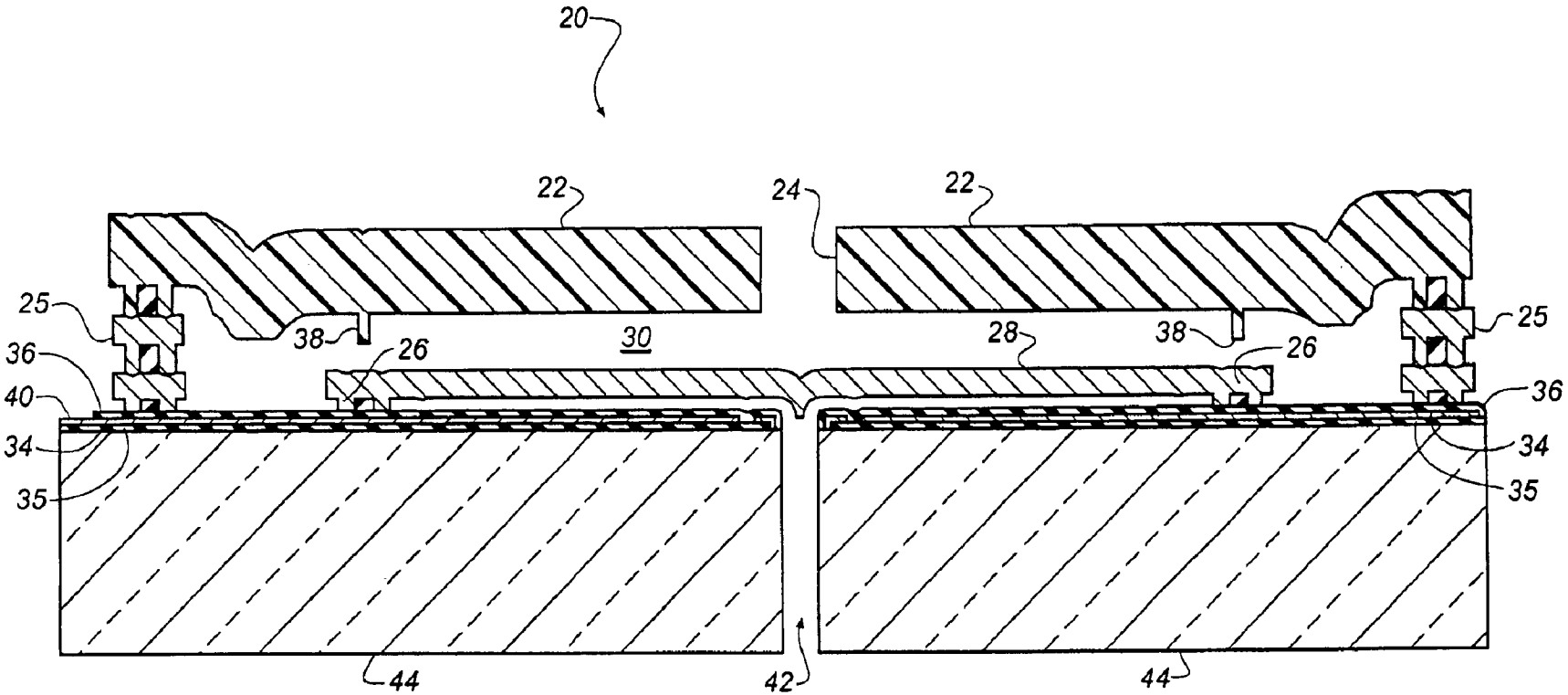
FIG. 7 is a cross-sectional view of the drop-on-demand liquid emission device of FIG. 1 taken along line B–B' of FIG. 2.
Figure 8:
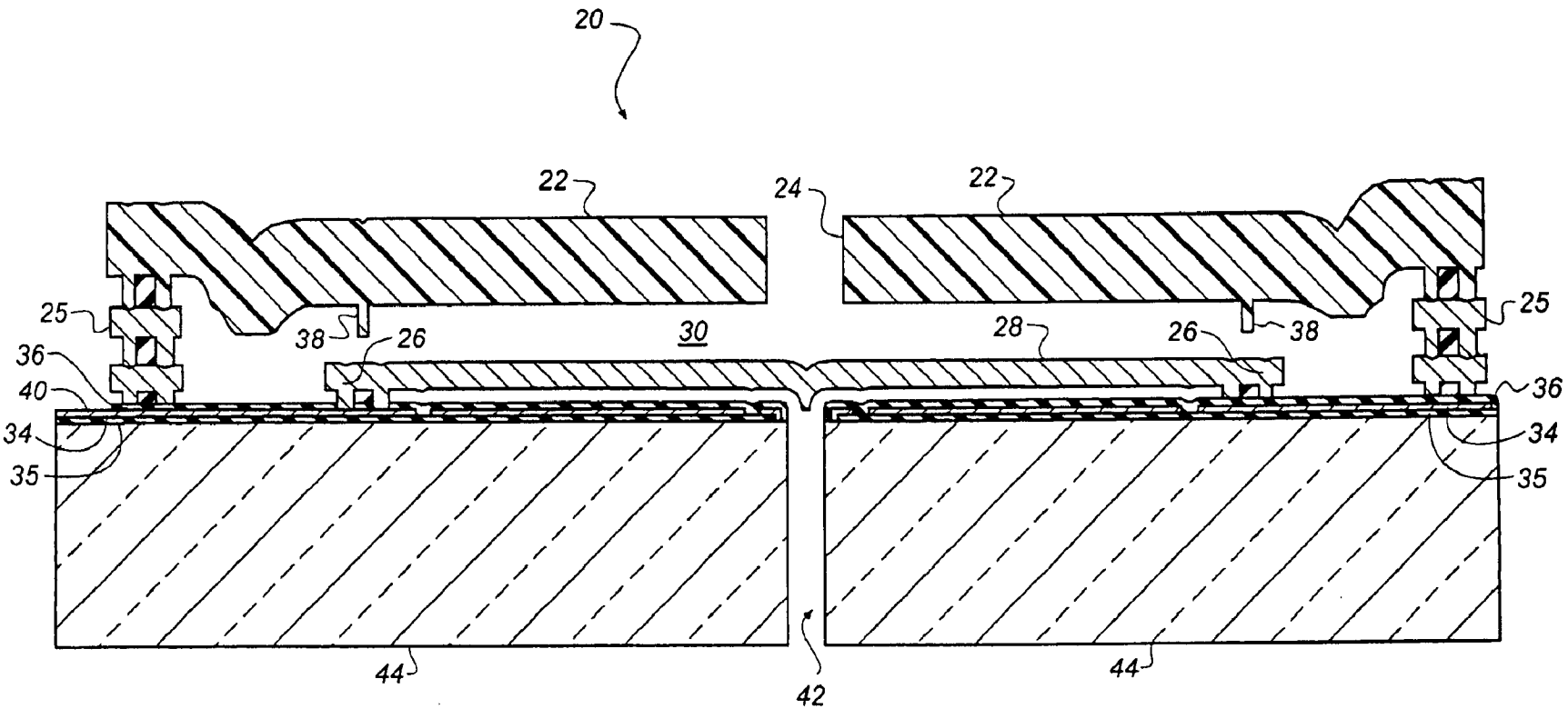
FIG. 8 is a cross-sectional view of the drop-on-demand liquid emission device of FIG. 1 taken along line C–C' of FIG. 2.

FIGS. 6, 7, and 8 are cross-sectional views of one of the plurality of electrostatically actuated drop ejection mechanisms 20 taken along line A–A', B–B', and C–C', respectively, of FIG. 2. A nozzle orifice 24 is formed in a nozzle plate 22 for each mechanism 20. The thickness of nozzle plate 22 is determined to constrain the plate against flexing, as any deformation represents a reduction in the drop ejection energy, and may inhibit drop formation. A wall or walls 26, which carry an electrically addressable deformable electrode 28, bound each drop ejection mechanism 20. The wall may comprise a single material or may comprise a stack of material layers, as shown in FIG. 6.

A portion of deformable electrode 28 is sealingly attached to outer wall 25 to define a liquid chamber 30 adapted to receive the liquid, such as for example ink, to be ejected from nozzle orifice 24. The liquid is drawn into chamber 30 through one or more refill ports 32 from a supply, not shown, typically forming a meniscus in the nozzle orifice. Ports 32 are sized as discussed below. Dielectric material fills the region on the side of deformable electrode 28 opposed to chamber 30. The dielectric material is preferably air or other dielectric gas, although a dielectric liquid may be used.

Typically, deformable electrode 28 is made of a somewhat flexible conductive material such as polysilicon, or a combination of layers having a central conductive layer surrounded by an upper and lower insulating layer. For example an alternative electrode 28 comprises a thin film of polysilicon stacked between two thin films of silicon nitride, each film for example, being one micron thick. In the latter case, the nitride acts to stiffen the polysilicon film and to insulate it from liquid in the chamber 30.

Addressable electrode 28 is preferably at least partially flexible and is spaced from a fixed electrode 34 such that the two electrodes are generally axially aligned with nozzle orifice 24.

Fixed electrode 34 is preferably made from a conductive central body, and is rigidly attached to walls 26. A first passivation layer 35 provides insulation of electrode 34 from the structural supports 44, while a second passivation layer 36 provides insulation of fixed electrode 34 from deformable electrode 28 during pulldown, when the two electrodes will be brought into mechanical contact. The thicknesses of passivation layers 35 and 36 are determined by the breakdown voltages of the passivation materials and the voltages applied when the electrodes are brought into contact.

Figure 9:
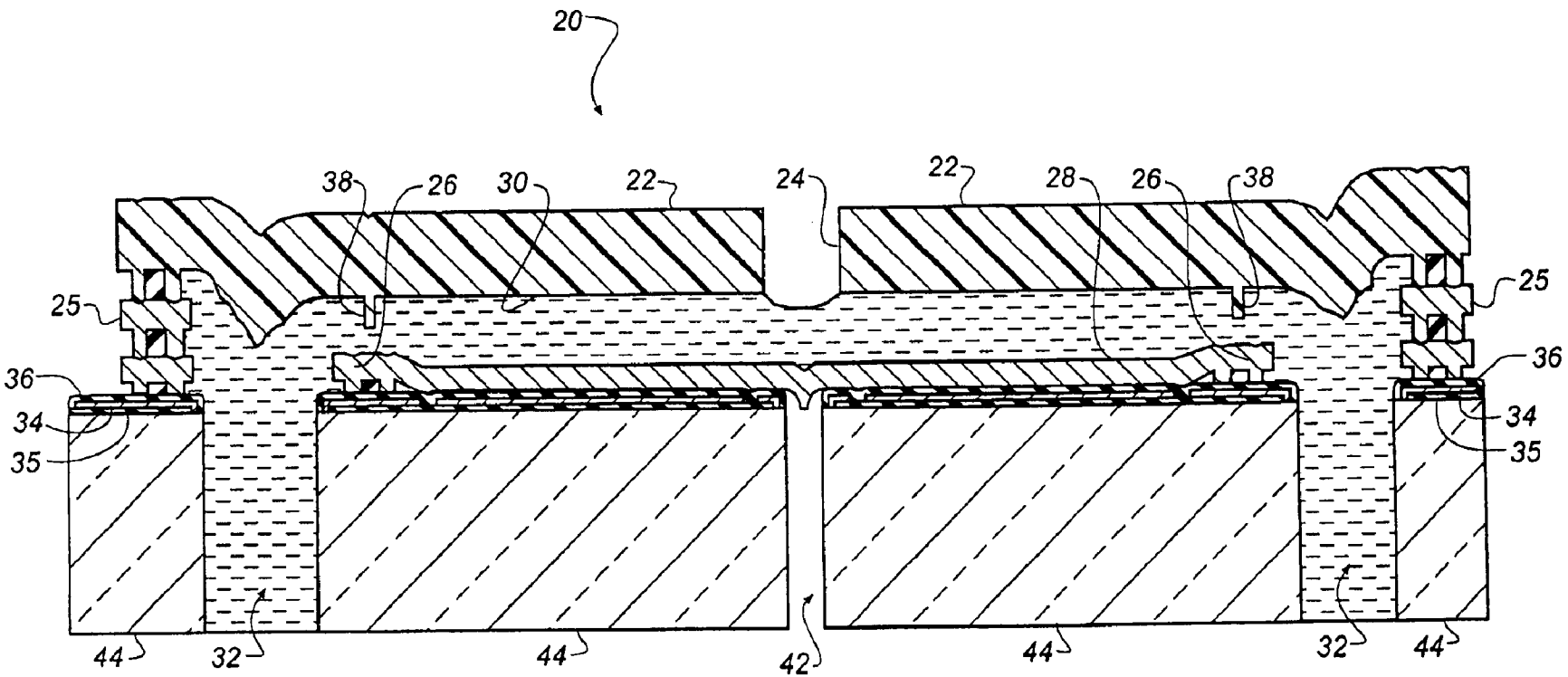
FIG. 9 is a cross-sectional view similar to FIG. 6 of the drop-on-demand liquid emission device of FIG. 2 shown in a first actuation stage.

Referring to FIG. 9, to eject a drop, voltage difference is applied between the polysilicon portion of deformable electrode 28 and the conductive portion of fixed electrode 34. Since deformable electrode 28 is in contact with the liquid in chamber 30, it may be preferable that fixed electrode 34 is powered while deformable electrode 28 remains at some reference voltage referred to as ground or zero. Deformable electrode 28 deforms and comes into mechanical contact with fixed electrode 34. The first passivation layer 35 between the two electrodes prevents electrical discharge. Since deformable electrode 28 forms a wall portion of liquid chamber 30 behind the nozzle orifice, movement of deformable electrode 28 away from nozzle plate 22 expands the chamber 30, drawing liquid into the expanding chamber through ports 32.

Figure 10:
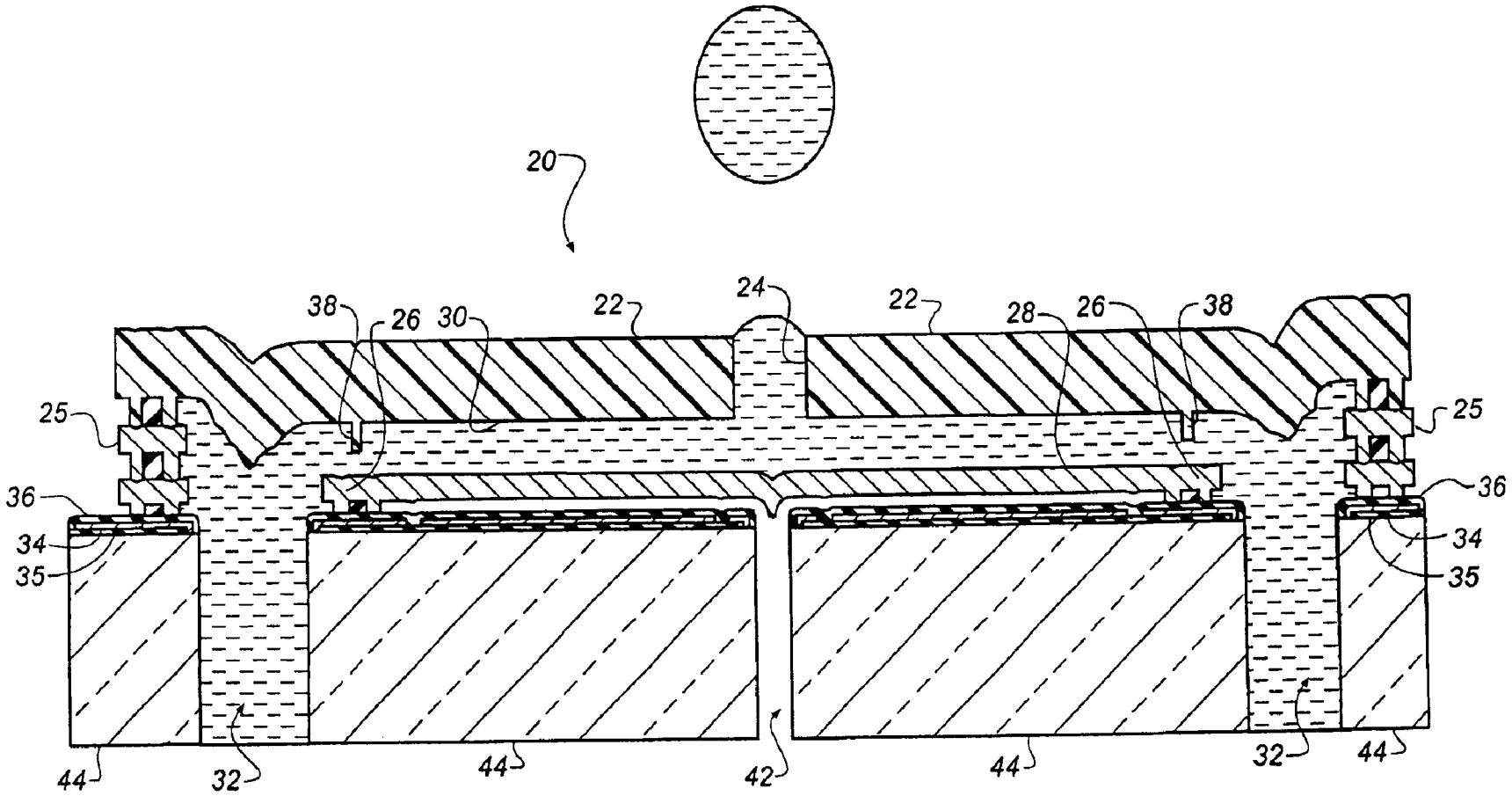
FIG. 10 is a cross-sectional view similar to FIG. 9 shown in a second actuation stage.

Subsequently (say, several microseconds later) deformable electrode 28 is de-energized, that is, the potential difference between electrodes 28 and 34 is made zero. Deformable electrode 28 begins to move from the position illustrated in FIG. 9 toward the position illustrated in FIG. 10 under the sole force of stored elastic potential energy in the system. Still referring to FIG. 10, this action pressurizes the liquid in chamber 30 behind nozzle orifice 24, causing a drop to be ejected from the nozzle orifice. To optimize both refill and drop ejection, ports 32 and flow restrictors 38 should be properly sized to present sufficiently low flow resistance so that filling of chamber 30 is not significantly impeded when deformable electrode 28 is energized, and yet present sufficiently high resistance to the back flow of liquid through the port during drop ejection. As deformable electrode 28 moves away from nozzle plate 22 to draw liquid into the expanding chamber through ports 32, some ambient environment is drawn in through nozzle orifice 24. Flow restrictor 38 can be sized to inhibit ingestion of the ambient environment during this step.

Referring again to FIG. 2, during operation, electrical signals are sent via electrical leads 40 to electrodes 28 and 34 of FIG. 6. The electrode structure is anchored to outer wall 26 by structural supports 44. Both outer wall 26 and structural supports 44 may either comprise a single layer or comprise a stack of material layers as shown in FIG. 7.

A second fluid path 42 shown in FIGS. 6–11 allows the dielectric material in a chamber below electrode 34 to flow into and out of a dielectric material reservoir (not shown). In the preferred embodiment, the dielectric material is air, and the ambient atmosphere performs the function of a dielectric material reservoir. Fluid path 42 forms a vent opening of predetermined cross-sectional area in fixed electrode 34. The ratio of the cross-sectional area of the vent opening to the perimeter of vent opening 34 being greater than 0.5 $\mu$m, and preferably about 5 $\mu$m.

Figure 11:
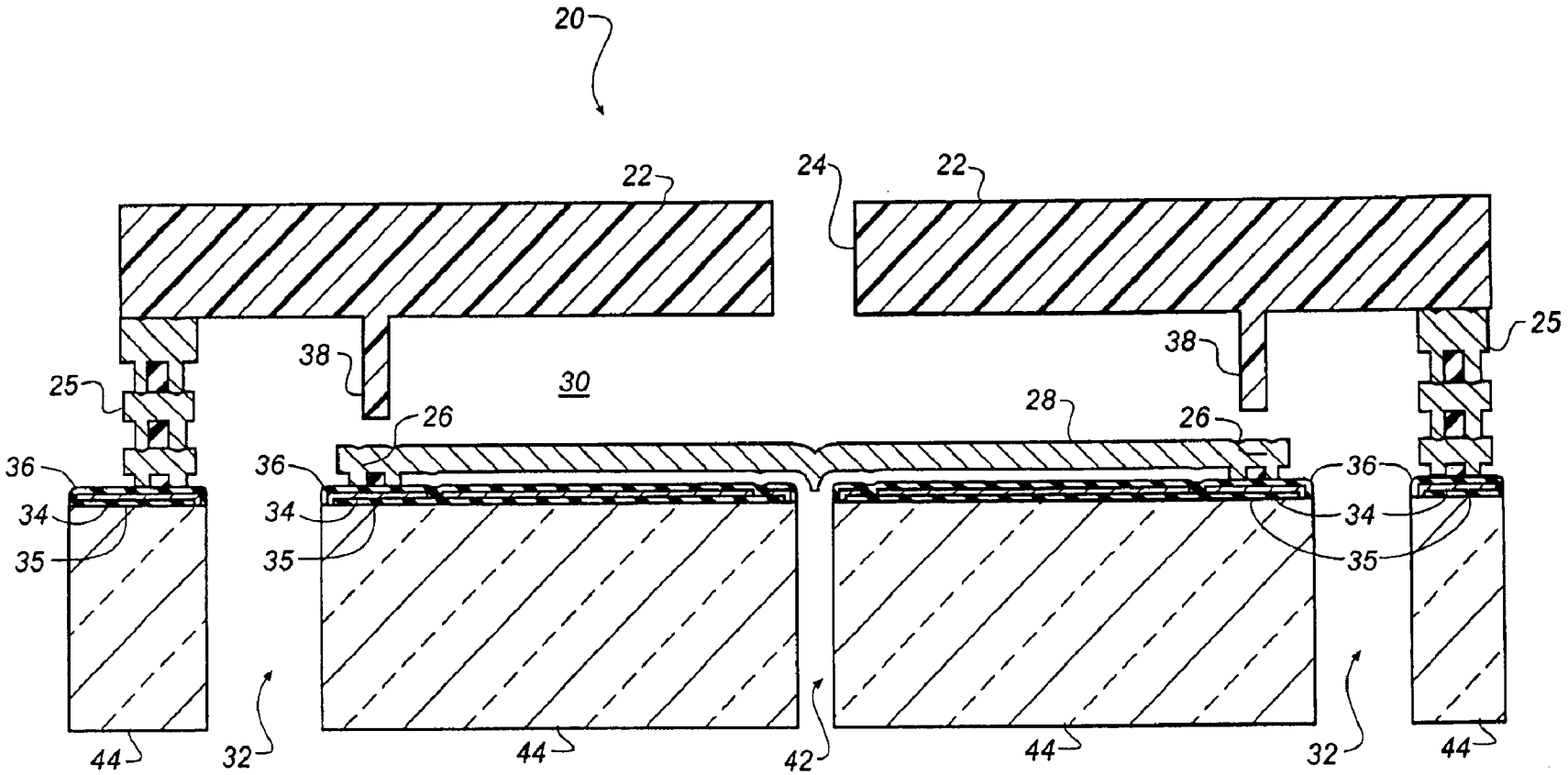
FIG. 11 is a cross-sectional view of another embodiment of the drop-on-demand liquid emission device of FIG. 1 taken along line A–A' of FIG. 2.

FIG. 11 illustrates and alternative embodiment of the present invention. The drawing is taken as if along line A–A' of FIG. 2. In this embodiment, nozzle plate 22 is formed separately from the rest of the device and is then bonded to the device. This eliminates some of the topography in the nozzle plate level.

What is claimed is:

1. An emission device for ejecting a liquid drop, said device comprising:

a first chamber of variable volume adapted to receive a liquid and having a nozzle orifice through which a drop of received liquid can be emitted;

an electrically addressable, deformable electrode associated with the first chamber such that movement of the deformable electrode in a first direction increases the first chamber's volume to draw liquid into the first chamber and movement of the deformable electrode in a second direction decreases the first chamber's volume to emit a drop of liquid from the first chamber through the nozzle orifice; and a fixed electrode, of predetermined perimeter, opposed to the deformable electrode and defining a second chamber there between such that control of relative voltage differences between the movable and the fixed electrodes selectively moves the deformable electrode in one of said first and second directions, said variable volume containing a dielectric material and being vented to a source of such dielectric material through an opening of predetermined area in the fixed electrode, the ratio of the area of said opening to the perimeter of said opening being greater than 0.5 $\mu$m.

2. An emission device for ejecting a liquid drop as defined in claim 1, wherein the deformable electrode is formed of a flexible conductive material.

3. An emission device for ejecting a liquid drop as defined in claim 2, wherein the deformable electrode is formed of polysilicon.

4. An emission device for ejecting a liquid drop as defined in claim 1, wherein the deformable electrode is formed of a central conductive layer surrounded by opposed insulating layers.

5. An emission device for ejecting a liquid drop as defined in claim 4, wherein the central conductive layer is polysilicon and the insulating layers are silicon nitride.

6. An emission device for ejecting a liquid drop as defined in claim 5, wherein the central conductive layer and the insulating layers are about one micron thick.

7. An emission device for ejecting a liquid drop as defined in claim 1, wherein the fixed electrode is formed of a conductive body and a passivation layer to insulate the fixed electrode from the deformable electrode.

8. An emission device for ejecting a liquid drop as defined in claim 1, wherein the emission device is a print head of an ink jet printing system.

9. An emission device for ejecting a liquid drop as defined in claim 8, wherein the fixed electrode is structurally stiff.

10. An emission device for ejecting a liquid drop as defined in claim 1, wherein the ratio of the cross-sectional area of said opening to the perimeter of the fixed electrode 15 about 5 $\mu$m.

11. An emission device for ejecting a liquid drop as defined in claim 10, wherein the deformable electrode is formed of a flexible conductive material.

12. An emission device for ejecting a liquid drop as defined in claim 11, wherein the deformable electrode is formed of polysilicon.

13. An emission device for ejecting a liquid drop as defined in claim 10, wherein the deformable electrode is formed of a central conductive layer surrounded by opposed insulating layers.

14. An emission device for ejecting a liquid drop as defined in claim 13, wherein the central conductive layer is polysilicon and the insulating layers are silicon nitride.

15. An emission device for ejecting a liquid drop as defined in claim 14, wherein the central conductive layer and the insulating layers are about one micron thick.

16. An emission device for ejecting a liquid drop as defined in claim 10, wherein the fixed electrode is formed of a conductive body and a passivation layer to insulate the fixed electrode from the deformable electrode.

17. An emission device for ejecting a liquid drop as defined in claim 10, wherein the emission device is a print head of an ink jet printing system.

18. An emission device for ejecting a liquid drop as defined in claim 17, wherein the fixed electrode is structurally stiff.

* * * * *

UNITED STATES PATENT AND TRADEMARK OFFICE

CERTIFICATE OF CORRECTION

PATENT NO. : 6,874,867 B2
DATED : April 5, 2005
INVENTOR(S) : Michael J. DeBar et al.

It is certified that error appears in the above-identified patent and that said Letters Patent is hereby corrected as shown below:

Column 6,
Line 27, please relace text "15 about 5$\mu$m." with the following corrected text -- is about 5 $\mu$m --

Signed and Sealed this

Fifth Day of July, 2005

JON W. DUDAS
*Director of the United States Patent and Trademark Office*